US010406574B2

(12) United States Patent
Denker et al.

(10) Patent No.: US 10,406,574 B2
(45) Date of Patent: Sep. 10, 2019

(54) STRIP DEFLECTOR AND ROLL ASSEMBLY

(71) Applicant: SMS GROUP GmbH, Duesseldorf (DE)

(72) Inventors: Wolfgang Denker, Freudenberg (DE); Kerstin Spill, Netphen (DE); Johannes Alken, Siegen (DE)

(73) Assignee: SMS GROUP GMBH, Duesseldorf (DE)

( * ) Notice: Subject to any disclaimer, the term of this patent is extended or adjusted under 35 U.S.C. 154(b) by 472 days.

(21) Appl. No.: 15/307,867

(22) PCT Filed: Mar. 6, 2015

(86) PCT No.: PCT/EP2015/054726

§ 371 (c)(1),
(2) Date: Nov. 7, 2016

(87) PCT Pub. No.: WO2015/169475

PCT Pub. Date: Nov. 12, 2015

(65) Prior Publication Data

US 2017/0056945 A1 Mar. 2, 2017

(30) Foreign Application Priority Data

| | | |
|---|---|---|
| May 5, 2014 | (DE) | 10 2014 208 333 |
| May 26, 2014 | (DE) | 10 2014 210 038 |
| Nov. 5, 2014 | (DE) | 10 2014 222 530 |

(51) Int. Cl.
*B21B 39/16* (2006.01)
*B21B 39/14* (2006.01)
(Continued)

(52) U.S. Cl.
CPC ..... *B21B 39/16* (2013.01); *B21B 27/10* (2013.01); *B21B 39/14* (2013.01); *B21B 45/0278* (2013.01)

(58) Field of Classification Search
CPC ..... B21B 45/0284; B21B 45/0281; B21B 45/0278; B21B 45/0233; B21B 45/0218;
(Continued)

(56) References Cited

U.S. PATENT DOCUMENTS

| | | | |
|---|---|---|---|
| 5,313,685 | A | 5/1994 | Kramer |
| 5,490,300 | A | 2/1996 | Horn |

(Continued)

FOREIGN PATENT DOCUMENTS

| | | | |
|---|---|---|---|
| FR | 2602700 | A | 2/1988 |
| RU | 2193936 | C1 | 12/2002 |
| SU | 1440571 | A1 | 11/1988 |

*Primary Examiner* — Pradeep C Battula
(74) *Attorney, Agent, or Firm* — Andrew Wilford

(57) ABSTRACT

A strip deflector has a base body formed with a tip, a compressed-air chamber, and a nozzle for emitting compressed air. A compressed-air source in flow communication with the compressed-air chamber feeds compressed air to the compressed-air chamber and the nozzle. This nozzle has a first nozzle subpassage in flow communication with the compressed-air chamber and a second nozzle subpassage downstream of the first nozzle subpassage in a flow direction. The first nozzle subpassage is formed by a flank closer to the tip of the base body and an opposite flank remote from the tip of the base body, and, at a transition from the first nozzle subpassage to the second nozzle subpassage, the flank closer to the tip of the base body is bent away toward the tip of the base body so as to form a first separation edge.

13 Claims, 3 Drawing Sheets

(51) Int. Cl.
*B21B 27/10* (2006.01)
*B21B 45/02* (2006.01)

(58) Field of Classification Search
CPC ... B21B 2027/103; B21B 37/32; B21B 37/74; B21B 39/14; B21B 39/16; B21B 27/10
See application file for complete search history.

(56) References Cited

U.S. PATENT DOCUMENTS

| | | | | |
|---|---|---|---|---|
| 5,628,223 | A | 5/1997 | Denker | |
| 5,775,152 | A | 7/1998 | Daub | |
| 6,260,287 | B1 | 7/2001 | Walker | |
| 6,928,753 | B2 | 8/2005 | Richter | |
| 9,108,235 | B2 * | 8/2015 | Kipping | B21B 27/10 |
| 9,901,964 | B2 * | 2/2018 | Kipping | B21B 27/10 |

* cited by examiner

STRIP DEFLECTOR AND ROLL ASSEMBLY

CROSS REFERENCE TO RELATED APPLICATIONS

This application is the US-national stage of PCT application PCT/EP2015/054726 filed 6 Mar. 2015 and claiming the priority of German patent application 102014208333.8 itself filed 5 May 2014 and German patent application 102014210038.0 itself filed 26 May 2014.

FIELD OF THE INVENTION

The present invention relates to a strip deflector. Strip deflectors typically serve as shields in roll stands for rolling metal strip. During rolling, the rolls are often loaded with a rolling medium such as a coolant and/or lubricant, and the strip deflector serves for contactlessly keeping the coolant or lubricant off the surface of the metal strip. In addition, the invention relates to a roll assembly with at least one roll and at least one strip deflector according to the invention.

With respect to more distant prior art, reference is made to European Patent Applications EP 0 765 696 [U.S. Pat. No. 5,775,152], EP 0 513 632 [U.S. Pat. No. 5,313,685] and EP 1 474 253 [U.S. Pat. No. 6,928,753] and U.S. Pat. Nos. 5,490,300 and 6,260,287.

The strip deflector according to the invention represents a development of the strip deflector such as disclosed in EP 0 662 359 [U.S. Pat. No. 5,628,223]. The strip deflector known from EP 0 662 359 B1 essentially consists of a base body with a tip. At least one compressed-air chamber as well as a nozzle for discharge of compressed air from the compressed-air chamber are formed in the base body. The compressed-air chamber is supplied by a compressed-air source that provides compressed air for the compressed-air chamber and the nozzle. The nozzle consists of a first nozzle subpassage communicating with the compressed-air chamber and a second nozzle subpassage downstream of the first nozzle subpassage in flow direction. The first nozzle subpassage consists of two substantially parallel flanks, wherein one flank is designated as closer to the tip of the base body and the other flank is designated as closer to away from the tip of the base body. At the transition from the first nozzle subpassage to the second nozzle subpassage the flank closer to the tip of the base body is bent away toward the tip of the base body so as to form a first separation edge. The second nozzle subpassage is formed substantially by a continuation or continuation section of the flank remote from the tip of the base body, in the flow direction beyond the first separation edge.

The strip deflector known from EP 0 662 359 comprises a nozzle slotted continuously over the width of the strip to be rolled or being rolled. With the help of the nozzle or the compressed air flow issuing from the nozzle a gap between the strip deflector and a roll, against which the strip deflector is placed, is sealed off—with use of the effect of Prandtl-Meyer corner flow—relative to coolant and/or lubricant present.

Prandtl-Meyer corner flow is a phenomenon from the field of gas dynamics, namely fluid redirection in the supersonic range. This effect of flow redirection and flow distribution leads to an effective sealing of a gap between the roll outer surface of a work roll and a strip deflector placed at the roll outer surface. In concrete terms, the effect effectively prevents penetration of coolant or lubricant from a region above the strip deflector into a region between the strip deflector and the surface of the rolled strip or strip to be rolled. Due to a high suction effect in the gap between the roll outer surface and the placed strip deflector, even further ambient air is conducted away or sucked away from the region between the strip deflector and the strip surface via the gap between the roll and the strip deflector into the region above the strip deflector. This has the advantage that the rolling medium can no longer deposit on the strip with disruptive effect. Guidance of the air flow is assisted by so-called Coanda effect in which the tendency of a fluid jet to run along a convex surface instead of settling or detaching can be recognised.

In practice it has proved that the constructional design of the strip deflector known from EP 0 662 359 is not entirely satisfactory with respect to various functions. In particular, the fact that the fluid—here compressed air—has to be accelerated to supersonic velocity in order to achieve the stated high suction action with the help of the Prandtl-Meyer corner flow has disadvantages. On the one hand, the high noise level connected with the supersonic velocity of the compressed air is to be cited as a disadvantage and on the other hand the extremely high and cost-intensive consumption of compressed air also connected therewith has to be mentioned. To be mentioned as a further disadvantage is the fact that due to the strongly radiused outlet region of the known nozzle the issuing air flow is conducted away in significant proportions from the roll surface as a consequence of the Coanda effect, as a result of which the sealing action is merely suboptimal. This suboptimal sealing action is attributable substantially to the fact that turbulence forms between the deflected air flow and the roll surface and conducts the medium to be deflected, in the immediate vicinity of the roll outer surface, in part back toward the strip deflector instead of conveying it away.

OBJECT OF THE INVENTION

The object of the invention is to improve upon a known strip deflector for deflection of rolling medium from metal strip in a roll stand as well as a known roll assembly for a strip deflector of that kind in such a way that the sealing effect of the strip deflector relative to a roll in a roll stand is improved.

SUMMARY OF THE INVENTION

This object is fulfilled in that the flank remote from the tip of the base body is bent away from the tip of the strip deflector so as to form a second separation edge at the end of the second nozzle subpassage.

The term "strip" in the sense of the present invention means a metal strip to be rolled or a rolled metal strip.

The term "separation edge" in the sense of the present invention means an edge having a cross-sectional profile that—in terms of a theoretical mathematical ideal—is formed to be constant, but not capable of differentiation. The first and second separation edges have the effect, due to their respective sharp-edged cross-section profile in practice, that air flow in the nozzle after passing the separation edge can no longer follow the shape of the nozzle, thus is not strongly deflected, but continues to flow in the original direction prior to the first nozzle subpassage.

The term "rolling medium" means cooling medium and/or lubricating medium applied, for rolling the strip, to the rolls or the strip.

The construction of the second separation edge offers the advantage that air flow at the end of the second nozzle subpassage in fact flows along substantially in its previous flow direction further on the roll outer surface or at least tangentially to the roll outer surface and does not—as described above in the prior art—follow the curvature at the end of the flank of the second nozzle subpassage due to Coanda effect and is conducted away from the roll outer surface. The air flow created by the second separation edge close to the roll outer surface advantageously has the effect that formation of turbulence in the air flow in the vicinity above the strip deflector is prevented, as a result of which the sealing effect of the strip deflector relative to an associated roll is significantly improved, because rolling medium is no longer conducted by eddies toward the strip deflector or toward the nozzle thereof.

The construction of the second nozzle subpassage with the second separation edge is extremely simple in geometric terms and thus inexpensive to make. Complicated radiusings and convex surfaces do not have to be produced. It is merely necessary to precisely determine and form the defined second separation edge.

According to a first embodiment the flank remote from the tip of the base body defines a unitary plane not only in the region of the first nozzle subpassage, but also in the region of the second nozzle subpassage.

A drop-shaped convexly curved flow guide profile formed between the stepped first separation edge and the tip of the base body offers the advantage that the gap between the strip deflector in the region between the tip of the base body and the nozzle and the opposing roll outer surface is clearly defined and free space that is otherwise present and that would be there without the flow guide profile is filled up. By filling the free or empty space, the formation of undesired eddies with undesired reversed air flow in this region is prevented and in this way the suction effect in the gap between the strip deflector and the roll outer surface, and rolling medium in the region between the strip deflector and the strip is sucked away, is improved. The air in the gap is conducted along the surface of the roll outer surface without formation of turbulence.

The curvature of the flow guide profile can advantageously be formed to be smaller, i.e. more acute, as the angle $\alpha$ decreases between the flow direction R in the first nozzle subpassage and a connecting line between the tip of the base body and the first separation edge.

Either a compressor for generating compressed air with, for example, <3 bars or a fan for generating compressed air with, for example, <1.5 bars can be used as compressed-air source. It is important that the air flow in the nozzle in the present invention in every case reaches only subsonic velocity; thus, the physical principle of the Prandtl-Meyer effect, which applies only to supersonic flows, is no longer of concern in the present invention. The use of a fan for generating pressurized air offers the advantage that the compressed air provided in this way is significantly less costly than factory compressed air typically provided. The limitation of the air flow to the subsonic velocity range advantageously ensures that noise output as well as the consumption of compressed air per unit of time are significantly reduced as compared to use of compressed air in the supersonic velocity range.

According to a further embodiment the strip deflector can have in width direction a plurality of pressure chambers that are each connected with the compressed-air source by a respective feed line. Preferably, each of the feed lines can be closed by a respective shut-off valve. Provision of the plurality of pressure chambers in conjunction with the individual shut-off valves offers the advantage that the used width of the strip deflector is in practice settable to the currently used roll width or to the width of the strip in that, in particular, the edge regions of the strip deflector can if required be disconnected by the shut-off valves from the compressed-air supply. In this way, it is advantageously possible for operating costs, particularly for the expensive compressed air consumption, to be reduced. Moreover, the described embodiment offers the advantage of increased variability of permissible frame geometries in that the strip thickness spectrum and the roll grind range can be variably adjusted without impairing functionality. The nozzle of the stripper according to the invention extends over the entire width of the strip deflector and can be formed either as a slot nozzle or from a plurality of individual bores.

The region of the tip of the base body is particularly wear-intensive, since during strip introduction and strip extraction and in the case of strip tears high loads repeatedly arise in this area. Forming the tip of the base body of the strip deflector as a separate component detachably connected with the base body offers the advantage that the tip can be simply exchanged as a wear component. This is typically significantly cheaper than exchange of the entire strip deflector. The tip of the base body can be made from, for example, metal or plastic.

The above-mentioned object is additionally attained by a roll assembly with at least one roll and at least one strip deflector spaced by a gap from the outer surface of the roll. In that case, the strip deflector is placed against the roll to be spaced at least in the region of the tip of the base body by a gap with a gap width d between 1 and 9 mm, preferably 5 mm. The short first nozzle subpassage ends at the first separation edge and the air then flows into the downstream second nozzle subpassage across the upper, second separation edge. Due to the inertia of the flow, the flow migrates from there to the opposing roll outer surface and thus contactlessly seals off the gap between the roll outer surface and the strip deflector. The mentioned strip width of up to approximately 9 mm advantageously allows discharge from the air region between the strip surface and the strip deflector of substantially more media-loaded air than is the case with the prior art nozzle operated with supersonic compressed air. With the known nozzle, the ratio of supplied compressed air to total discharged air quantity had a factor of 1:3. With the increase in the air gap according to the present invention up to approximately 9 mm, the ratio is increased to more than 1:4, for example, 1:5. The problem of particles of rolling medium remaining on the strip is significantly reduced, as a result of which the quality of the strip is significantly improved. Further advantages of the roll assembly correspond with the advantages mentioned above with reference to the strip deflector. The strip deflector according to the invention does not have to be moved up in a position-controlled manner; instead a predefined abutment is usually sufficient. However, this is dependent on the overall geometry, particularly the roll grind due to roll wear. The strip deflector according to the invention does not necessarily have to be attached to a movable setting device in order to be able to be moved out of the housing aperture during a roll change. A stationary arrangement of the strip deflector according to the invention between the work roll chocks in the respective roll housing is recommended for the wear-intensive environment of a hot-rolling mill. The strip deflector according to the invention is suitable not only for placement against the upper work roll, but also for placement against the lower work roll in a roll stand.

In order to increase the sealing effect it can be useful in specific individual cases to arrange at least two strip deflectors according to the invention (one above the other) on the outer surface of the roll. The use of several strip deflectors according to the invention is recommended, for example, in the outlet or on the outlet side of a roll stand if an outlet-side roll cooling is provided there, because then a considerable amount of cooling medium has to be discharged at the outlet side.

BRIEF DESCRIPTION OF THE DRAWING

The description is accompanied by three figures, in which.

SPECIFIC DESCRIPTION OF THE INVENTION

Figure 1:
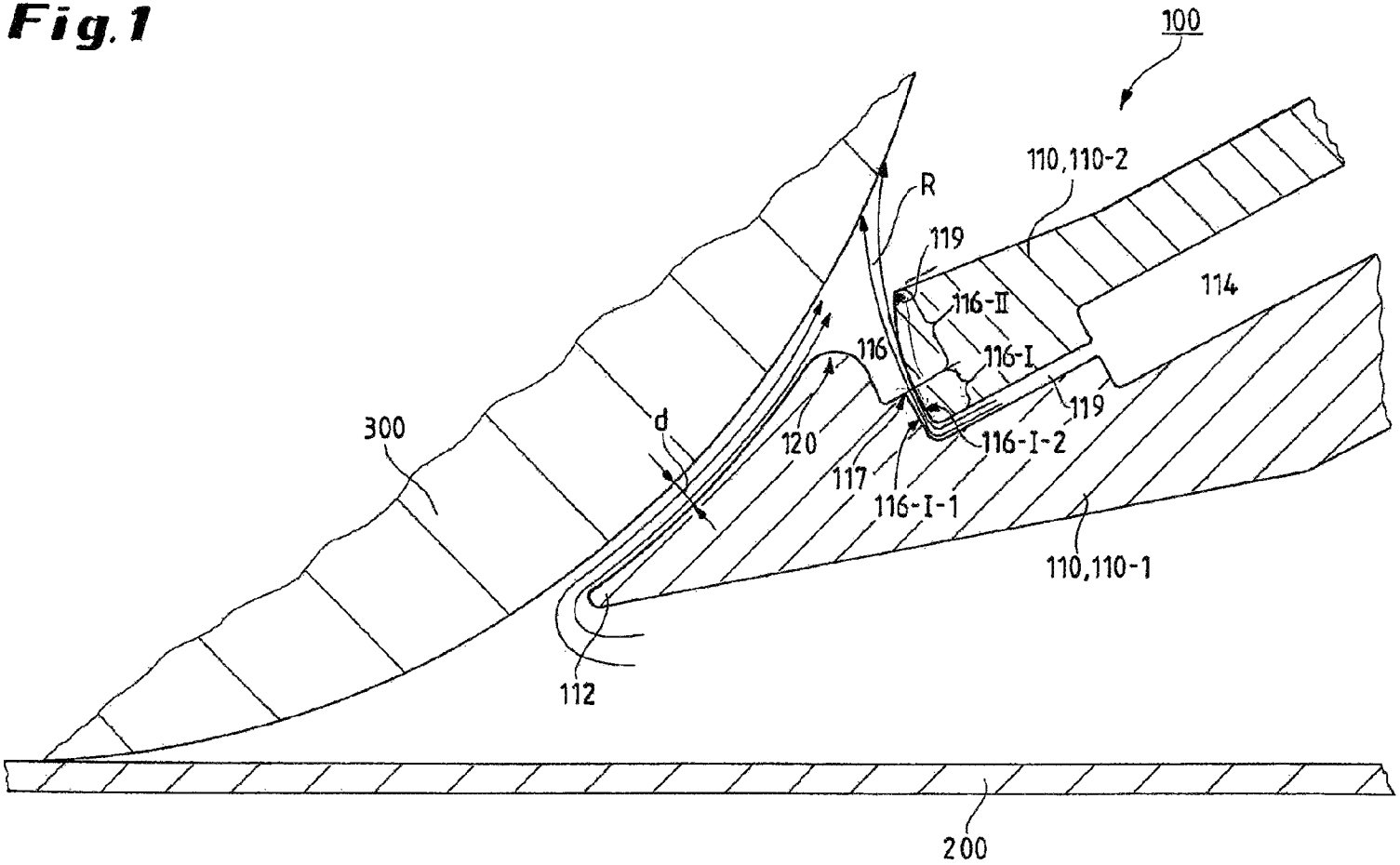
FIG. 1 is a cross-section through a first embodiment of the roll assembly according to the invention with the strip deflector according to the invention.

The embodiments of the invention are described in detail in the following with reference to FIGS. 1 to 3. The same elements are denoted in all figures by the same reference numerals.

Figure 2:
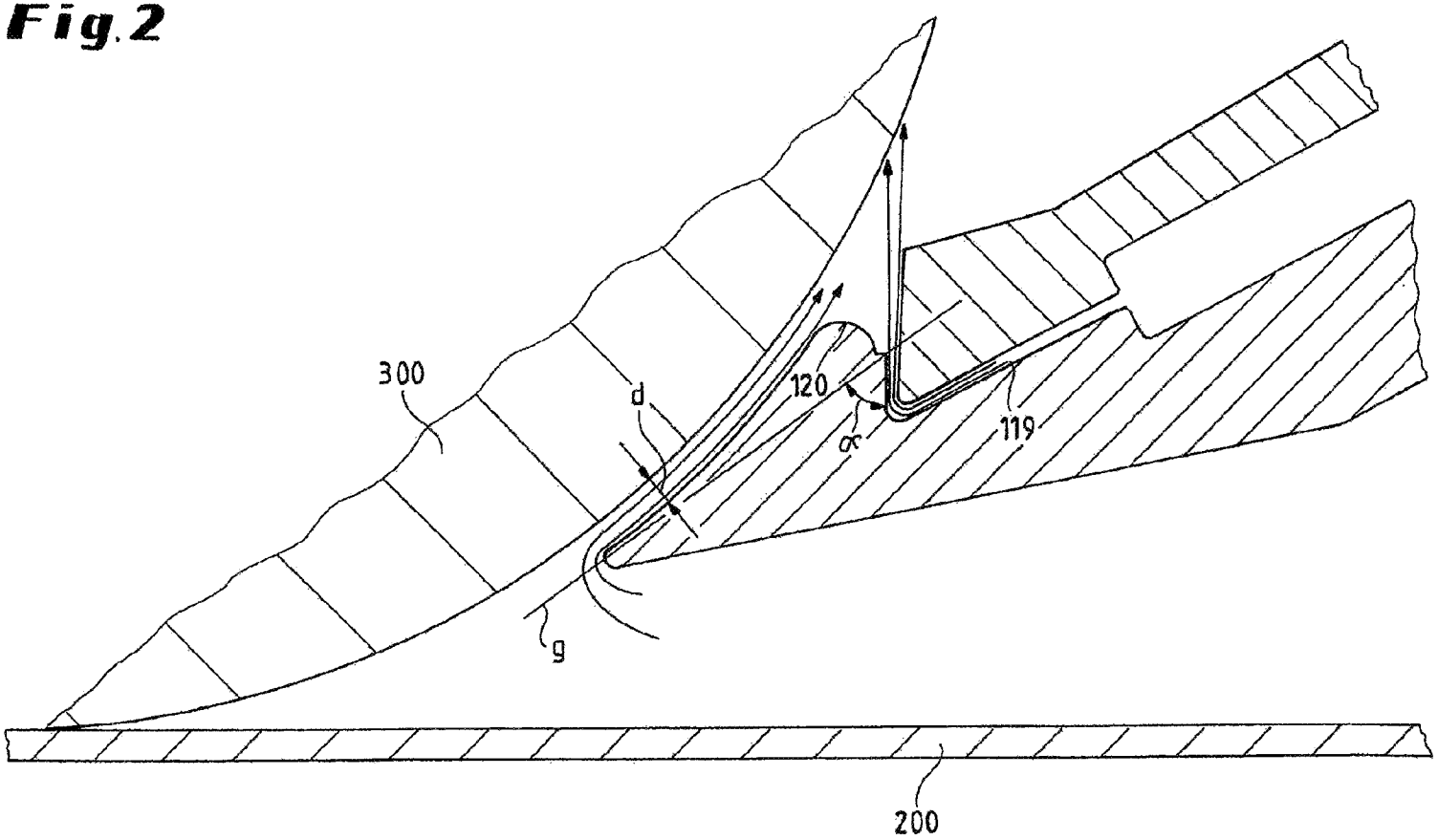
FIG. 2 shows a second embodiment of the roll assembly according to the invention in accordance.

The roll assembly according to the invention can be seen in FIG. 1, according to which a strip deflector 100 according to the invention is juxtaposed with the outer surface of a roll 300. The metal strip 200 to be rolled or being rolled can be seen in the lower region of FIG. 1, extending tangentially with respect to the roll outer surface. The strip deflector 100 is positioned by its base body 110 with a gap between itself and the roll 300. The gap width d is, for example, 1 to 9 mm.

The strip deflector 100 consists substantially of the base body 110 formed with at least one compressed-air chamber 114 and a nozzle 116 communicating with the compressed-air chamber for discharge of compressed air against the outer surface of the roll 300. The compressed air is provided by a compressed-air source 118 (see FIG. 3) communicating with the compressed-air chamber 114. The flow-conducting connection between the compressed-air chamber 114 and the nozzle 116 can be constructed in the form of, for example, a connecting passage 115.

The nozzle 116 consists of a first nozzle subpassage 116-I communicating with the compressed-air chamber 114 and a second nozzle subpassage 116-II downstream of the first nozzle subpassage in a flow direction R of the compressed air. The first nozzle subpassage 116-I can either be formed directly as a continuation of the compressed-air chamber 114 or be connected in terms of flow with the compressed-air chamber 114 by an intermediate passage 119.

In concrete terms the first nozzle subpassage 116-I consists of two flanks 116-I-1 and 116-I-2 preferably extending spacedly parallel to each other, the first flank 116-I-1 being designated as that closer to a tip 112 of the base body 110 and the other, opposite flank 116-I-2 being remote from the tip 112 of the base body.

In the transition from the first nozzle subpassage to the second nozzle subpassage the flank 116-I-1 closer to the tip 112 of the base body 110 is bent away toward the tip 112 of the base body so as to form a first separation edge 117.

A drop-shaped convexly curved flow guide profile 120 is preferably formed between the stepped first separation edge 117 and the tip 112 of the base body 110. The flow guide profile 120 merges, preferably by a concave curvature preferably formed to be curved smoothly, i.e. without formation of kinks, into the tip 112 of the base body 110. The curvature of the flow guide profile 120 can be smaller, proportional to an angle $\alpha$ is between the flow direction R in the first nozzle subpassage 116-I and a connecting straight line g between the tip 112 of the base body and the first separation edge 118 (see FIG. 2).

In the case of a suitable construction, as an alternative to the angle $\alpha$, the angle between the direction of the first nozzle subpassage 116-I and the intermediate passage can possibly also serve as a stop point for the height of the curvature of the flow guide profile 120. In the case of the embodiment shown in FIG. 1, a right angle is formed between the first nozzle subpassage 116-I and the intermediate passage 115 [119]. By contrast, in the embodiment shown in FIG. 2 an acute angle is formed between the first nozzle subpassage 116-I and the intermediate passage [115]. Accordingly, the curvature of the flow guide contour 120 can be less pronounced in the case of the embodiment shown in FIG. 2 than in the case of the embodiment shown in FIG. 1.

The second nozzle subpassage 116-II forms the continuation of the first nozzle subpassage and is defined or bounded substantially by the continuation of the side 116-I-2 remote from the tip 112 of the base body, in flow direction R beyond the height of the separation edge 117. The flank 116-I-2 remote from the tip of the base body is bent away from the tip 112 of the strip deflector so as to form a second separation edge 119 at the end of the second nozzle subpassage 116-II.

It is important that not only the first separation edge 117, but also the second separation edge 119 be sharp with a smallest possible radius of curvature so as to ensure that the air flow at the two separation edges does not follow the bent-over profile of the base body in these regions due to Coanda effect, but instead flows in its original flow direction further along on the roll outer surface or at least tangentially to the surface of the roll outer surface.

The flanks remote from the tip 112 of the base body 110 can each be formed as a single common plane in the region of the first nozzle subpassage 116-I and the second nozzle subpassage 116-II. Alternatively, the flanks in both nozzle subpassages or also only in the second nozzle subpassage up to the second separation edge can be formed to be bent slightly convexly away from the tip 112. However, the convex curvature should then at most be so strongly formed, particularly in the region of the second nozzle subpassage 116-II up to the second separation edge 110, that the air flow—for a given placement of the strip deflector 100 against the outer surface of the roll 300—still impinges on the surface of the roll 300 or at least flows tangentially along the outer surface thereof when exiting from the nozzle. In other words, the convex curvature in this region should only be so strongly formed—for a given position of the strip deflector relative to the roll—that a tangent to the flank 116-II of the second nozzle subpassage at the second separation edge still hits on the roll outer surface or is at least tangential thereto.

The tip 112 of the strip deflector 100 is preferably constructed to be detachably connectable as a separate component with the base body. This is advantageous, because in practice the tip is subject to a high level of wear. It can be made of metal or plastic.

Figure 3:
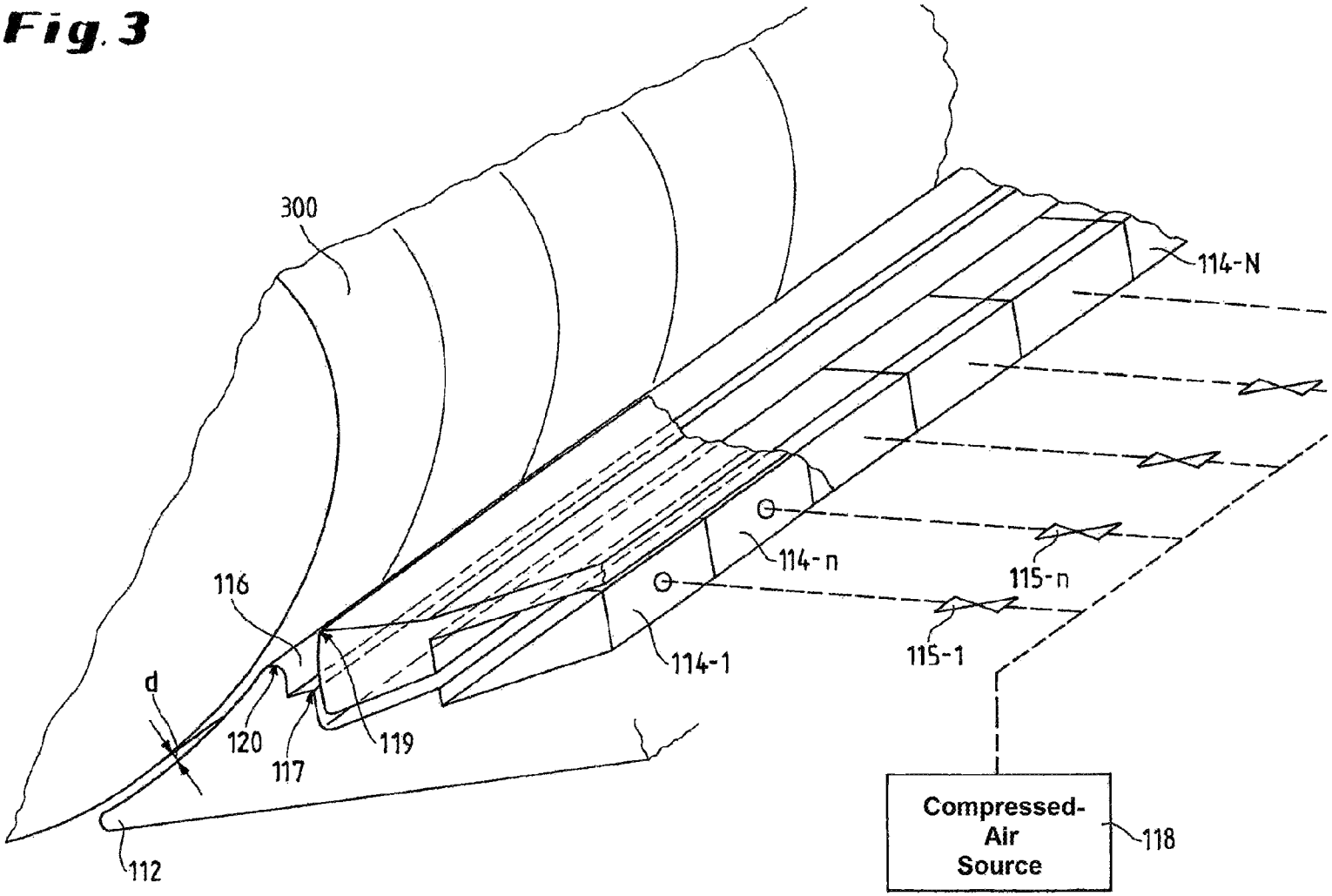
FIG. 3 shows a third embodiment of the roll assembly according to the invention in a perspective view.

FIG. 3 shows how the nozzle can be formed to be, for example, slot-shaped. Alternatively, however, it can also be formed with a plurality of individual nozzles or individual bores that communicate with the compressed-air chamber 114.

FIG. 3 also shows how the compressed-air chamber 114 can be constructed in the form of a plurality of N individual compressed-air chambers 114-*n*, where 1≤n≤N and each of the individual compressed-air chambers is provided for supply of a specific section of the nozzle 116 in width direction with compressed air. For this purpose the individual compressed-air chambers 114-*n* are preferably each connected with the compressed-air source 118 by an individual feed line. Each of the feed lines can be preferably individually blocked by an individual shut-off valve 115-*n*, where 1≤n≤N. The advantage of this embodiment in terms of the compressed air supply of the nozzle 116 being variably adaptable in width direction to the width of the respective strip 200 to be rolled or being rolled was already described above.

In constructional terms the base body 110 of the strip deflector according to the invention can be formed from a lower shaped part 110-1 and an upper shaped part 110-2.

The invention claimed is:

1. A strip deflector for contactless deflection of a rolling medium from the surface of a strip comprising:

a base body forming formed with a tip, with at least one compressed-air chamber, and with at least one nozzle for emitting compressed air; and a compressed-air source in flow communication with the compressed-air chamber for feeding compressed air to the compressed-air chamber and the nozzle, wherein the nozzle has a first nozzle subpassage in flow communication with the compressed-air chamber and a second nozzle subpassage downstream of the first nozzle subpassage in a flow direction, the first nozzle subpassage is formed by a flank closer to the tip of the base body and an opposite flank remote from the tip of the base body, at a transition from the first nozzle subpassage to the second nozzle subpassage, the flank closer to the tip of the base body is bent away toward the tip of the base body so as to form a first separation edge, the second nozzle subpassage is bounded by a continuation of the flank remote from the tip of the base body and beyond the first separation edge in the flow direction; and the flank remote from the tip of the base body is bent away from the tip of the strip deflector so as to form a second separation edge at the end of the second nozzle subpassage.

2. The strip deflector according to claim 1, wherein a section that bounds the second nozzle subpassage of the flank remote from the tip of the base body defines a unitary or common plane or is formed to be convexly curved both in the region of the first nozzle subpassage and in the region of the second nozzle subpassage.

3. The strip deflector according to claim 1, wherein a drop-shaped, convexly curved flow guide profile is formed between the offset first separation edge and the tip of the base body.

4. The strip deflector according to claim 3, wherein an angle is between the flow direction in the first nozzle subpassage and a connecting line that is between the tip of the base body and the first separation edge; the smaller the angle, the smaller the curvature of the flow guide profile.

5. The strip deflector according to claim 1, wherein the compressed-air source is a compressor for generating compressed air at 3 bars or a fan for generating compressed air at 1.5 bars, and air flow in the nozzle in both cases attains only a subsonic velocity.

6. The strip deflector according to claim 1, wherein the strip deflector has in a width direction a plurality of pressure chambers that are each connected with the compressed-air source by a respective feed line each in turn individually closable by a respective shut-off valve.

7. The strip deflector according to claim 1, wherein the nozzle is formed as a slot nozzle over an entire width of the strip deflector.

8. The strip deflector according to claim 1, wherein the nozzle is formed over an entire width of the strip deflector from a plurality of individual nozzles.

9. The strip deflector according to claim 1, wherein the tip of the base body of the strip deflector is detachably connected as a separate component with the base body.

10. The strip deflector according to claim 1, wherein the tip is made of metal or plastic.

11. A roll assembly comprising at least one roll and at least one strip deflector according to claim 1, wherein the strip deflector in the region of the tip of the base body is spaced from the roll by a gap with a gap width d of d=1 to 9 mm.

12. The roll assembly according to claim 11, wherein two or more of the strip deflectors are angularly spaced about the roll.

13. The roll assembly according to claim 11, wherein the flank remote from the tip of the base body, of the second nozzle subpassage is convexly curved, the convex curvature for a given placement of the strip deflector against the roll being formed to be merely so small that a tangent to the flank of the second nozzle subpassage at the second separation edge still extends through the roll body or is at least tangential thereto.

* * * * *